US009863248B2

(12) United States Patent
Moon

(10) Patent No.: US 9,863,248 B2
(45) Date of Patent: Jan. 9, 2018

(54) FRICTION BOLT

(71) Applicant: Jason L. Moon, Spring Creek, NV (US)

(72) Inventor: Jason L. Moon, Spring Creek, NV (US)

( * ) Notice: Subject to any disclaimer, the term of this patent is extended or adjusted under 35 U.S.C. 154(b) by 0 days.

(21) Appl. No.: 14/694,854

(22) Filed: Apr. 23, 2015

(65) Prior Publication Data

US 2016/0312610 A1 Oct. 27, 2016

(51) Int. Cl.
*E21D 21/00* (2006.01)
*E02D 5/80* (2006.01)

(52) U.S. Cl.
CPC ..... *E21D 21/0033* (2013.01); *E02D 5/80* (2013.01); *E02D 5/805* (2013.01); *E21D 21/004* (2013.01)

(58) Field of Classification Search
CPC ..... E21D 21/004; E21D 21/0073
See application file for complete search history.

(56) References Cited

U.S. PATENT DOCUMENTS 4,098,087 A * 7/1978 Swain ..... E02D 5/76 175/171
4,312,604 A 1/1982 Fu et al.
4,498,815 A * 2/1985 Dye ..... E21D 21/0086 405/302.1
4,634,317 A 1/1987 Skogberg et al.
4,696,606 A * 9/1987 Herron ..... E21D 21/004 29/421.1
4,704,053 A * 11/1987 Hipkins, Sr. ..... E21D 20/02 405/259.1
5,054,146 A * 10/1991 Wiesenfeld ..... B21B 1/163 405/259.5
7,004,686 B2 2/2006 Mocivnik et al.
7,270,501 B2 9/2007 Kanflod et al.
7,367,751 B2 5/2008 Vosbikian
8,714,883 B2 5/2014 Rataj
2007/0196183 A1* 8/2007 Valgora ..... E21D 21/004 405/259.3
2010/0166505 A1* 7/2010 Barrett ..... E02D 3/12 405/259.5
2011/0299939 A1 12/2011 Craven et al.
2012/0034036 A1 2/2012 Davison
(Continued)

FOREIGN PATENT DOCUMENTS

CA 1171310 7/1984
CA 2483081 A1 * 3/2005 ..... E21D 21/004
EP 0540601 A1 5/1993
(Continued)

OTHER PUBLICATIONS

PYTHON Expandable Rock Bolts, Jennmar USA, available at least as early as Apr. 23, 2015 (p. 38).

*Primary Examiner* — Frederick L Lagman
(74) *Attorney, Agent, or Firm* — Holland & Hart LLP

(57) ABSTRACT

A friction bolt including an elongated metal tube and a plurality of friction members. The metal tube includes interior and exterior surfaces, a tapered distal end portion, a proximal end portion, and a slit extending along a length of the elongated metal tube. The plurality of friction members extend outward from the exterior surface, and at least some of the friction members have an exposed planar portion to frictionally engage an inner surface of a bore within which the friction bolt is inserted.

19 Claims, 9 Drawing Sheets

(56) References Cited

U.S. PATENT DOCUMENTS

| | | | |
|---|---|---|---|
| 2013/0236251 | A1 | 9/2013 | Smith et al. |
| 2014/0119839 | A1 | 5/2014 | Krekula et al. |

FOREIGN PATENT DOCUMENTS

| | | | |
|---|---|---|---|
| EP | 0600007 | B1 | 1/1996 |
| WO | 9201859 | A1 | 2/1992 |
| WO | 2005047650 | A1 | 5/2005 |
| WO | 2010090500 | A3 | 8/2010 |
| WO | 2011079829 | A2 | 7/2011 |
| WO | 2012083317 | A1 | 6/2012 |

* cited by examiner

FRICTION BOLT

TECHNICAL FIELD

The present disclosure generally relates to rock bolts and related rock bolt systems, and particularly relates to friction rock bolts and related methods of manufacturing and installing friction rock bolts.

BACKGROUND

There are many types of rock bolt devices commercially available for installation within bore holes that are drilled into earthen formations. Rock bolts provide reinforcement in various settings, such as underground mining sites throughout the world. Rock bolts may also be referred to as rock stabilizers and ground stabilizers.

Rock bolts can be grouped into classes including, for example, friction rock bolts, expansion rock bolts, and cement/resin rock bolts. Rock bolts are typically inserted into a drilled bore in an earthen formation such as a rock formation. The drilled bore is most often formed in a ceiling surface of an underground tunnel. The rock bolt is held in the bore with a friction or adhesive interface with an inner surface of the bore. The rock bolt may be used to attach a wire mesh or other retention structure against the ceiling of the underground tunnel. The type of rock bolt and the interaction between the rock bolt and the drilled bore determine an amount of pull strength or load that the rock bolt provides. Friction rock bolts usually provide the lowest amount of pull strength, but are typically easier to install and are the least expensive rock bolt option. Expansion rock bolts and cement/resin rock bolts usually provide greater pull strength, but are often more expensive and complex to install.

Friction rock bolts generally comprise an elongate tube of a substantially circular cross-section and a channel or groove extending longitudinally along the entire length of the tube. Friction rock bolts are usually installed in a bore that has a smaller diameter than the outer diameter of the friction rock bolt. The friction rock bolt is driven into the hole and held in place within the bore with an interference fit. The tube is subject to radial compression forces as a result of being driven into the bore, which causes the channel or groove to be reduced thereby reducing the diameter of the tube to conform to the diameter of the bore. The resulting frictional engagement between the friction rock bolt and the earthen formation is sufficient to provide a load carrying capacity (e.g., pull strength) for the friction rock bolt.

Expansion rock bolts usually have a smaller outer diameter than the diameter of the bore into which the rock bolt is inserted. A radially outward directed force is applied internally within the rock bolt to expand the rock bolt radially outward to create a friction interface with the bore inner surface. In one example, the expanding mechanism is a wedge that is forced internally within the tube, and the wedge creates the radially outward directed force that expands the diameter of the rock bolt into contact with the bore inner surface. In another example, a fluid such as water is forced into the interior of the tube thereby creating a radially outward expansion force. The applied radial expansion force alters a shape of the tube, thereby causing permanent deformation that maintains a frictional interface with the bore.

Cement/resin rock bolts use injection of a cement or resin composition between an outer surface of the inserted tube and the inner bore surface to create a connection therebetween. The cement/resin is allowed to cure thereby providing a bond between the outer surface of the tube and the bore surface. This bond provides the desired frictional interface between the rock bolt and the bore.

The processes involved in handling fluids used in expansion rock bolts as well as the cements and resins used with cement/resin rock bolts may add significant time, cost, and complexity to installation of such rock bolts, which may, in at least some circumstances, outweigh their potential added benefits of increased load-carrying capacity.

Therefore, there is a need for improvements in rock bolt designs and related methods of installing rock bolts.

SUMMARY

According to one aspect of the present disclosure, a friction bolt includes an elongated metal tube and a plurality of friction members. The metal tube includes interior and exterior surfaces, a tapered distal end portion, a proximal end portion, and a slit extending along a length of the elongated metal tube. The plurality of friction members extend outward from the exterior surface, and at least some of the friction members have an exposed planar portion to frictionally engage an inner surface of a bore within which the friction bolt is inserted.

At least some of the friction members may have a triangular shape. The triangular shape may have a greater length than width, and the friction members may be oriented with the length aligned with a length dimension of the elongated metal tube. The friction members may be formed integrally as a single piece with the elongated metal tube. The friction bolt may further include a flange positioned at the tapered distal end portion, wherein the flange is configured to support a mesh. The friction members may be arranged in a pattern on the exterior surface. At least some of the friction members may have a tapered thickness from a distal end toward a proximal end of the friction members. The exposed planar portion may extend along a proximal end surface of the at least some of the friction members. The exposed planar portion may extend along lateral side surfaces of the friction members.

Another aspect of the present disclosure is directed to a friction bolt that includes an elongated tube having a slit extending along at least a portion of a length of the elongated tube, and a plurality of friction members extending outward from an exterior surface of the elongated tube. At least some of the friction members have at least one linear edge.

At least some of the friction members may include a plurality of planar surfaces. At least some of the friction members may include a plurality of linear edges. At least some of the friction members may include a pointed distal tip. At least some of the friction members may be tapered along their lengths. At least some of the friction members may include a planar surface having the at least one linear edge. The friction members may be arranged in a pattern of rows and columns.

A further aspect of the present disclosure is directed to a method of forming a friction bolt from a sheet of material. The method includes forming a plurality of friction members in the sheet of material, wherein the friction members have at least one of a linear edge and a planar portion, and rolling the sheet of material into a tube shape with the friction members extending from an exterior surface of the tube shape.

The method may also include providing a slit in the friction bolt extending a long a length thereof. The method may include providing a tapered distal tip in the friction bolt.

Forming the friction members may include forming the friction members with a triangular peripheral shape. Forming the friction members may include embossing the friction members.

The above summary is not intended to describe each embodiment or every implementation of embodiments of the present disclosure. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
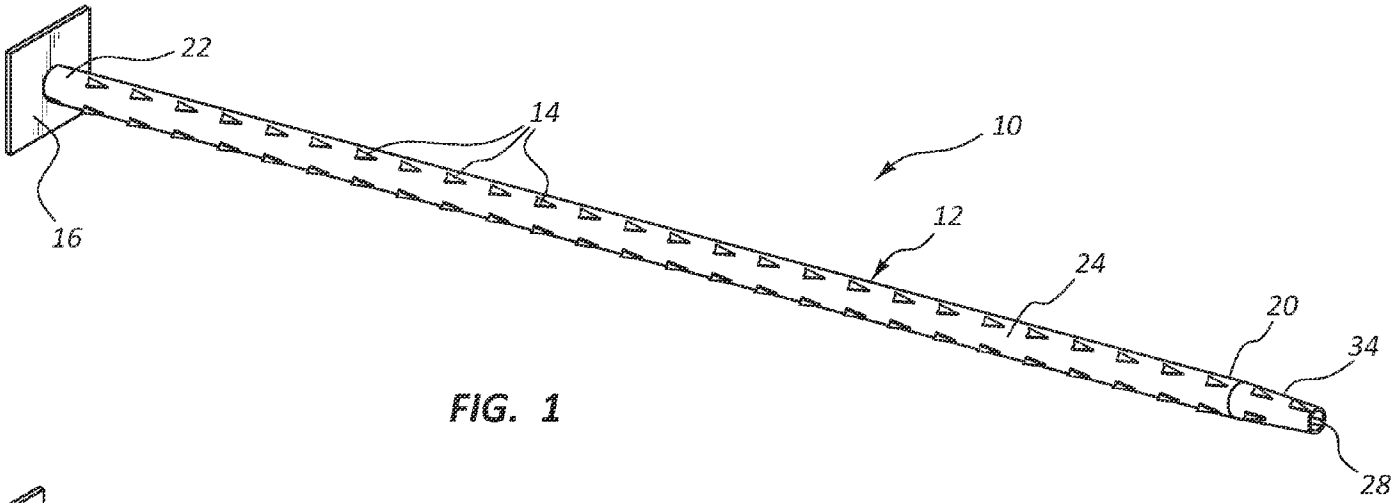
FIG. 1 is a perspective view of an example friction bolt assembly in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure is directed to rock bolts, related methods of manufacturing rock bolts, and methods of using rock bolts to secure and/or support an earthen formation such as the ceiling of a mining tunnel. As discussed above, there are various types of rock bolts, many of which may benefit from the features and functionality disclosed herein. One type of rock bolt that may benefit from the friction features disclosed herein are friction rock bolts, which may also be referred to as split set bolts, friction lock bolts, split rock bolts, and the like.

Friction rock bolts typically include a slit along their length, which permits radially inward compression or reduction of the outer diameter of the friction rock bolt as the friction rock bolt is inserted into a bore formed in an earthen formation. A friction rock bolt provides a friction interface with the inner surface of the bore, which friction holds the friction rock bolt within the bore and provides a desired pull strength. The friction rock bolts disclosed herein may provide an improved pull strength as compared to other known friction rock bolt designs. As mentioned, at least some of the features and functionality described herein with reference to friction rock bolts may be applied to other types of rock bolts such as expansion bolts and cement/resin bolts.

One aspect of the present disclosure is directed to the use of friction members and/or structures that are positioned along an exposed exterior surface of a rock bolt (e.g., a surface of the rock bolt that is facing radially outward). The friction members may increase a friction interface between the exposed exterior surface of the rock bolt and the inner surface of a bore into which the rock bolt is inserted. The friction members may be formed as a plurality of discreet, individually formed, spaced apart structures positioned along the exposed exterior surface of the rock bolt. In some embodiments, at least some of the friction members may be interconnected, overlapping, and/or formed as a continuous structure along a length or around a circumference of the rock bolt. The friction members may have any of a variety of different shapes, sizes, relative spacings, thicknesses, orientations, and the like. Some example friction members are shown and described with reference to FIGS. 1-10B. Many other embodiments are possible for the friction members. Any structure positioned along an exposed outer surface of a rock bolt that is arranged and configured to increase a friction interface between the rock bolt and the inner surface of a bore may be considered a friction member and may provide the desired increase in friction interface between the rock bolt and surface of the bore.

The friction members may be integrally formed with the tube structure of a rock bolt. In some embodiments, the friction members are separately formed and connected to the tube member of the rock bolt in a separate assembly step. The friction members may be formed using a variety of different forming techniques including, for example, embossing, welding, punching, braising, machining, etching, casting, press forming, heat shaping, and the like. Some types of forming processes and methods are best suited for or more practical when forming the friction members on a contoured surface such as along an outer exterior exposed surface of a tube member of a rock bolt, while the formation of other friction members may be better suited for forming on a planar surface such as a sheet of material that is later rolled into a tubular-shaped member. In still further examples, the friction members may be formed on a sleeve that is attached to a tube member of the rock bolt assembly in a separate assembly step. In this way, a plurality of separately formed friction members may be mounted to the rock bolt assembly in an assembly step.

The present disclosure provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Figure 2:
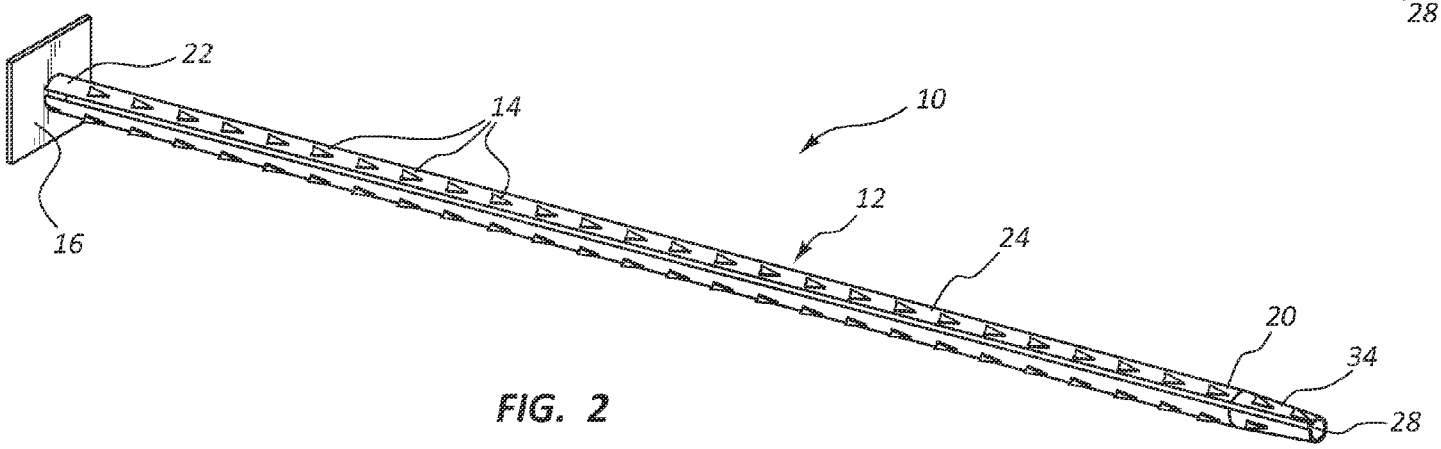
FIG. 2 is another perspective view of the friction bolt assembly shown in FIG. 1.

Referring now to the figures in detail, FIGS. 1 and 2 show a friction bolt assembly 10 in different perspective views. The friction bolt assembly 10 includes a tube 12, a plurality of friction members 14, and a flange 16. The friction members 14 are positioned along an exposed outer surface of the tube 12 at various locations along the length of the tube 12. The flange 16 is positioned at a proximal end of the tube 12. The flange 16 may be used to help insert the friction bolt assembly 10 into a bore that has been formed in an earthen formation such as a rock formation. In at least one example, the bore is formed in a ceiling of a tunnel, such as a mining tunnel. The flange 16 may be used to hold a mesh or other material sheet against the ceiling surface thereby holding the earthen structure together and preventing loose material from dropping into the tunnel. In at least one example, as many as 4 to 10 rock bolts may be used to hold a given 8'×8' sheet of mesh material in place on the ceiling surface.

The tube 12 may include distal and proximal ends 20, 22, outer and inner surfaces 24, 26 (e.g., see FIG. 5), a slit 28 defining first and second edges 30, 32 (see FIG. 2), and a tapered distal end portion 34. The friction members 14 are positioned on the outer surface 24 (see FIGS. 4 and 5). The slit 28 typically extends along an entire length of tube 12 from the distal end 20 to the proximal end 22. In some examples, the slit may initiate at a location proximal of the tapered portion 34.

Figure 3:
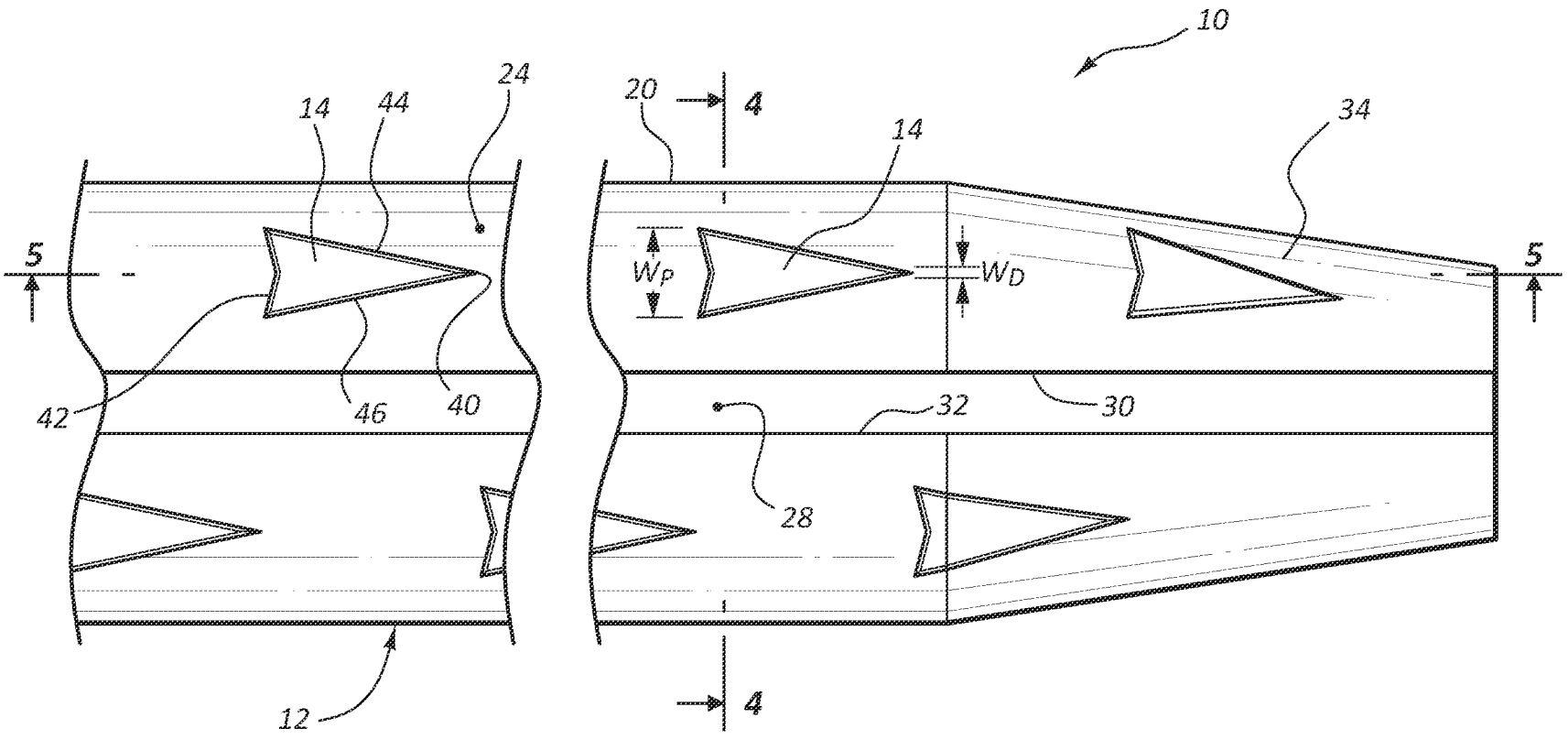
FIG. 3 is a close-up view of the friction bolt assembly shown in FIG. 2.
Figure 4:
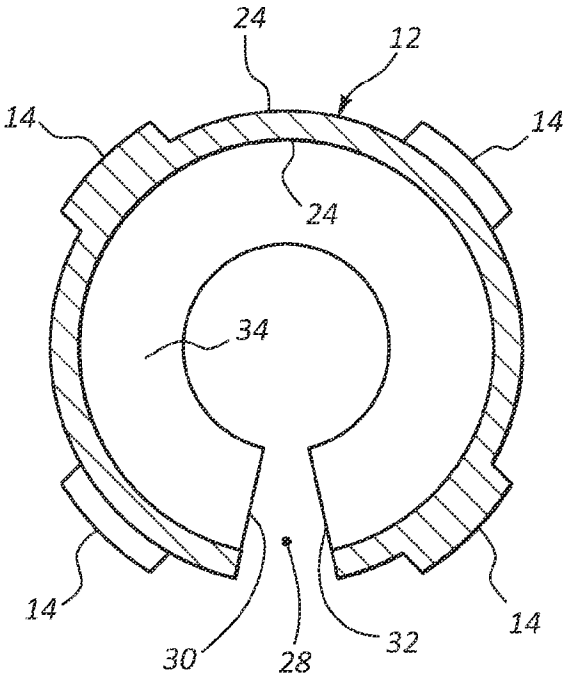
FIG. 4 is a cross-sectional view of the friction bolt assembly shown in FIG. 3 taken along cross-section indicators 4-4.
Figure 5:
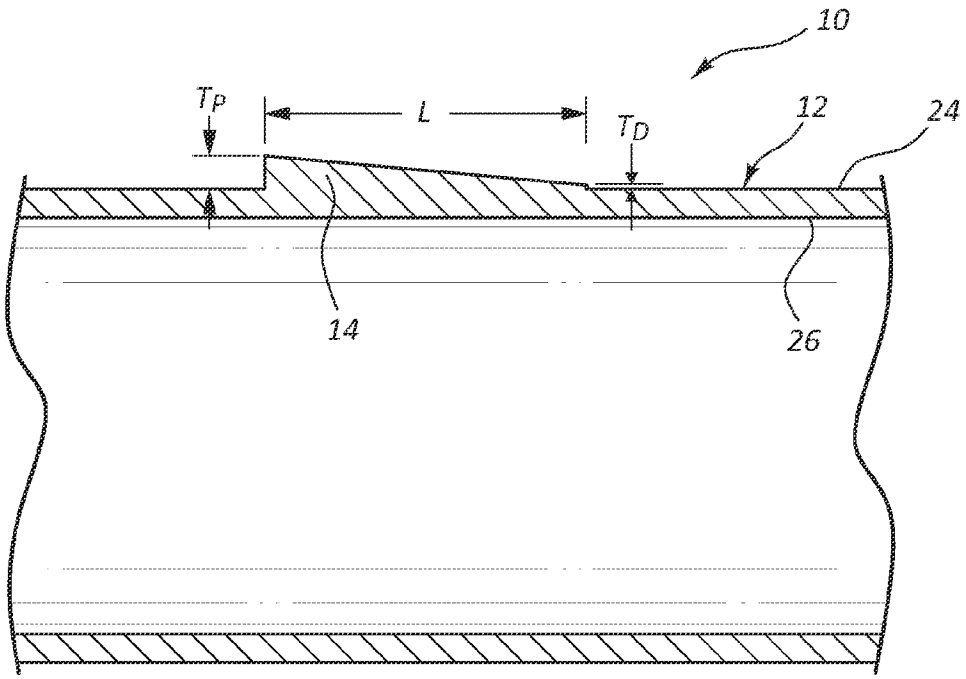
FIG. 5 is cross-sectional view of a portion of the friction bolt assembly shown in FIG. 3 taken along cross-section indicators 5-5.
Figure 7A:
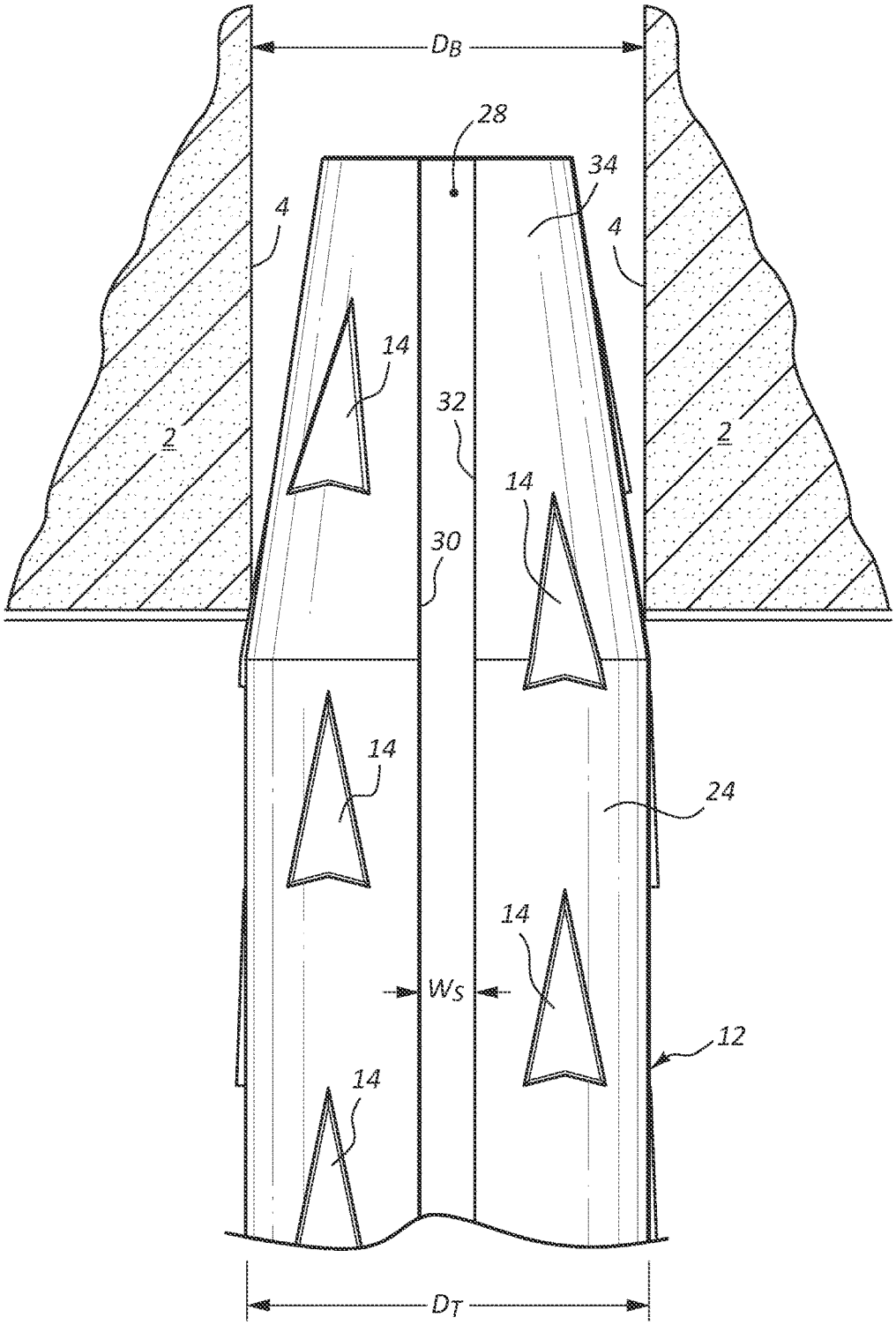
FIGS. 7A and 7B show steps of inserting the friction bolt assembly of FIGS. 1-5 into a bore.
Figure 7B:
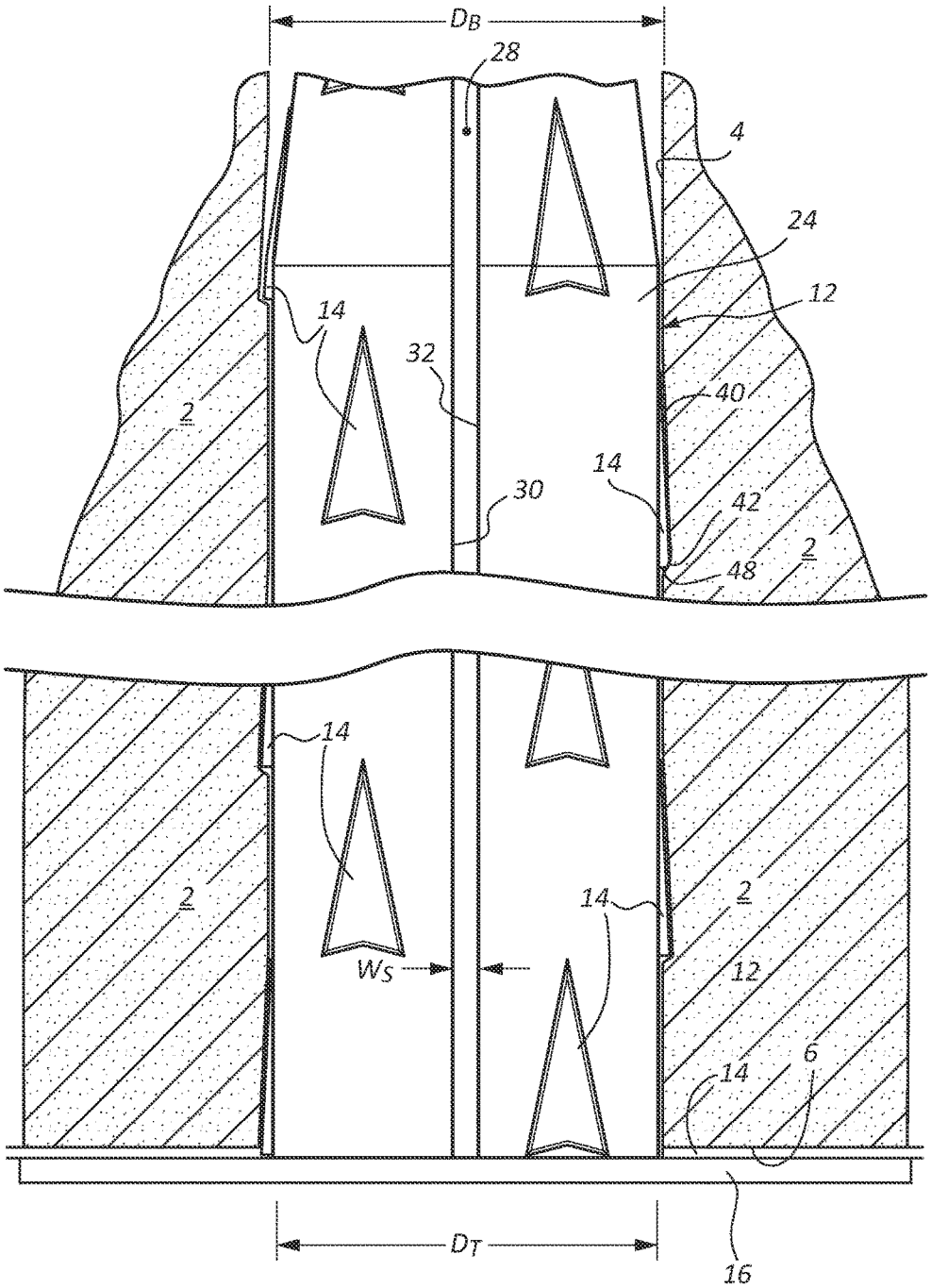

Referring to FIGS. 3-5, the friction members 14 may include a distal tip 40, a proximal end edge 42, lateral sides 44, 46, and a proximal end surface 48 (see FIG. 7B). The friction members 14 may also have a proximal thickness $T_P$ (see FIG. 5), a distal thickness $T_D$ (see FIG. 5), a proximal width $W_P$ (see FIG. 3), a distal width $W_D$ (see FIG. 3), and a length L (see FIG. 5). The friction members 14 have a generally triangular shape with the pointed distal tip 40 pointing towards the distal end 20 of the tube 12. The wide of the friction member 14 may taper or narrow toward the distal tip 40. The friction member 14 may have a tapered width and a tapered thickness along the length L. The friction member 14 may have a thickness that varies across the width thereof. At least a portion of friction member 14 may extend radially outward from a primary, radially outward facing surface of the tube 12. The primary, radially outward surface of tube 12 may completely surround friction member 14, may have a relatively constant curvature, and/or may be substantially smooth and without discontinuities. In at least some embodiments, the friction members 14 provide the only discontinuities on the primary, radially outward facing surface of tube 12.

The friction members 14 may be aligned with a longitudinal axis or a length dimension of tube 12. The friction members 14 may have a greater length L than a maximum width $W_P$. In other embodiments, friction members 14 may have different triangular shapes, such as a unilateral triangle (e.g., see FIG. 8A).

At least FIG. 5 shows the friction members 14 having a tapered construction from the distal end tip to the proximal end edge 42. The thickness may vary (e.g., taper) from a relatively small distal thickness $T_d$ to an increased or greater proximal thickness $T_p$. In some examples, the distal thickness $T_d$ may be close to zero (e.g., about 0 inches to about 0.1 inches) and the proximal thickness $T_p$ is greater than zero (e.g., about 0.05 inches to about 0.3 inches). This tapered construction for the friction member 14 (which may also be referred to as a tapered thickness along its length and may provide a ramp surface or a sloped surface) may create limited resistance when inserting the friction bolt assembly 10 into a bore while providing a proximal edge or surface and/or proximal corners or tips that catch on the surface of the bore when the friction bolt assembly 10 is pulled in a direction opposite from the insertion direction (e.g., provide increased friction when attempted to be removed from the bore). This interaction between the proximal end edge 42 and/or proximal end surface 48 of friction members 14 with the inner surface of the bore provides increased friction that resists removal of the friction bolt assembly 10 from a bore.

The increased friction provided by friction members 14 increases the pull strength available by the friction bolt assembly 10. An increased pull strength may provide a number of advantages including, for example, a reduced number of friction bolt assemblies needed to hold up a certain square footage of mesh, a reduction in length of the friction bolt assembly while still maintaining the same pull strength as a longer friction bolt assembly, the ability to provide desired amounts of pull strength for given earthen structures such as sandstone versus granite or coal, and improved safety ratings for any given earthen structure as compared to other types of rock bolts that do not include the friction members.

The proximal end surface 48 may be referred to as a planar proximal surface. The lateral sides 44, 46 may also be referred to as planar surfaces of friction members 14. The edges of friction member 14 extending from the distal end tip 40 to the proximal end edge 42 may be referred to as a linear edges, and the proximal end edge 42 may also be referred to as a linear edge. The edges and planar surfaces of friction member 14 may be relatively straight or linear. In other examples, the edges and planar surfaces or other surfaces along the lateral and proximal portions of the friction member may have contoured shapes, a plurality of planar and/or linear sections or portions, and various other types of structures, shapes and sizes.

Furthermore, the friction members 14 may be arranged on the outer surface 24 in a particular pattern. The pattern of the friction members 14 may provide certain advantages. The pattern may include rows and/or columns of friction members along the length or around a circumference of the tube 12. In some embodiments, friction members 14 of different sizes and shapes may be included on a single tube 12. In one example, one row or column of friction members may have one shape, size, and/or orientation, and another row or column may have a different, shape, size and/or orientation for the friction members. In other embodiments, the friction members 14 may be positioned at random locations relative to each other rather than in a particular pattern.

A single friction member 14 may extend around an entire circumference of tube 12 from one edge 30 to the other edge 32. In other embodiments, such as those shown in FIGS. 1-5, a plurality of friction members 14 may be spaced apart around a circumference of tube 12 between edges 30, 32. Similarly, a single friction member 14 may extend from distal end 20 to proximal end 22. Alternatively, a plurality of separate friction members 14 may be spaced apart along a length of the tube from distal end 20 to proximal end 22. A single friction member 14 extending continuously around a circumference of the tube 12 may be referred to as a lip or ring friction member. In some embodiments, a single friction member 14 may extend circumferentially and longitudinally on the tube 12, such as a helical-shaped friction member 14.

A given rock bolt 10 may include a plurality of friction members in the range of about 10 to about 1000 friction members 14, and more particularly in the range of about 50 to about 200 friction members 14. Each individual friction member 14 may contribute to an increase in friction with a bore into which the rock bolt 10 is inserted.

Figure 8A:
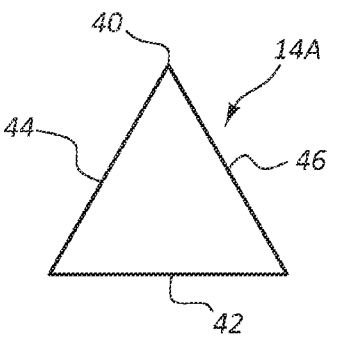
FIGS. 8A-8F show alternative friction member designs for use with the friction bolt assembly shown in FIGS. 1-5.
Figure 8B:
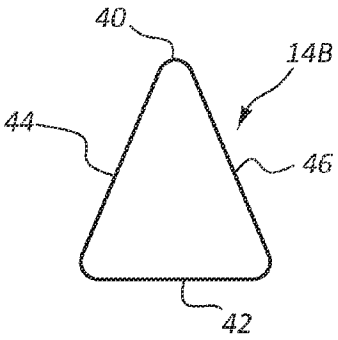
Figure 8C:
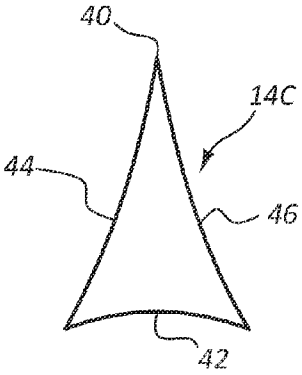
Figure 8D:
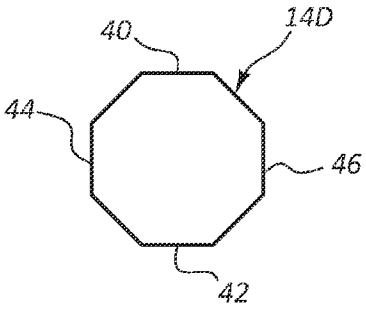
Figure 8E:
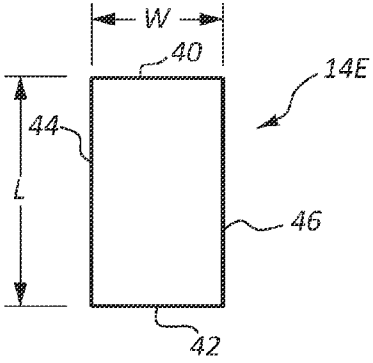
Figure 8F:
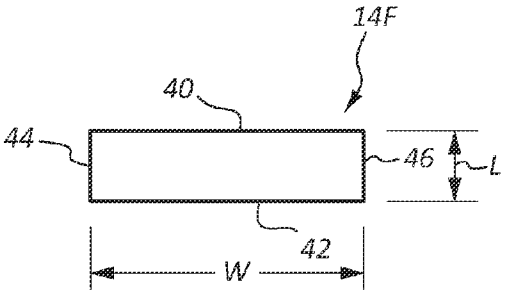

FIGS. 8A-8F show some alternative designs for friction members 14A-14F. FIG. 8A shows a friction member 14A having a unilateral triangular shape. FIG. 8B shows a friction member 14B having a generally triangular shape with rounded corners. FIG. 8C shows a friction member 14C having a triangular shape with at least some of the edges being contoured or having contoured portions. FIG. 8D shows an octagonal-shaped friction member 14D. FIGS. 8E and 8F show friction members 14E, 14F having rectangular shapes. Friction member 14E has a length L that is greater than a width W, whereas friction member 14F has a greater width W than length L.

Typically, each of the friction members 14A-14F include at least one linear edge and/or one planar surface. The linear edge may extend along a distal, lateral or proximal portion of the friction member. The planar surface extend along any one of the distal, lateral, or proximal portions of the friction member. The planar portion may be a surface of the friction member that is facing radially outward and is arranged generally parallel with an outer exposed surface of a tube to which the friction member is mounted. The shape, size and orientation of the friction members 14A-14F typically excludes hemispherical-shaped structures, but may include spherical or semi-spherical shaped portions in at least some embodiments.

Figures 6A, 6B, 6C, 6D:
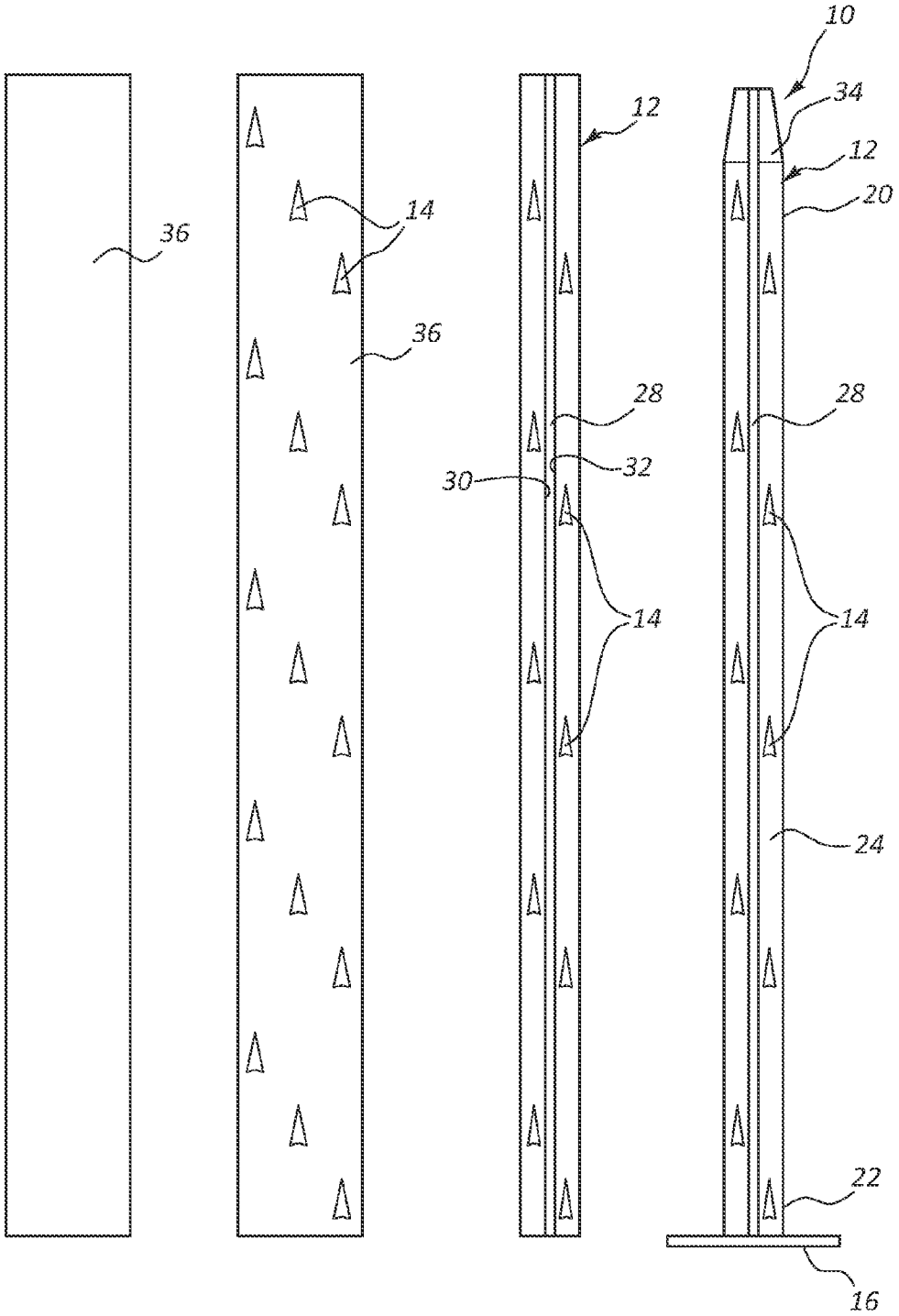
FIGS. 6A-6D show steps of an example method of forming the friction bolt assembly shown in FIGS. 1 and 2.

FIGS. 6A-6D show steps of forming and/or manufacturing a friction bolt assembly in accordance with one embodiment of the present disclosure. FIG. 6A shows a sheet of material such as a sheet of metal material from which at least a portion of the friction bolt assembly is formed. The sheet of material 36 may have a length that substantially matches a finished length of the resultant friction bolt assembly. In at least some examples, the sheet of material 36 has one surface upon which a plurality of friction members 14 are positioned.

FIG. 6B shows a plurality of friction members 14 positioned along at least one surface of the sheet of material 36. The friction members 14 are shown arranged in a pattern of rows and columns. Other arrangements are possible for the friction members 14 including, for example, friction members that are interconnected with each other rather than being spaced apart. The friction members 14 may be arranged in other patterns such as one or more helical patterns, or the like.

The friction members 14 may be formed in any of a number of different ways. In one example, the friction members 14 are formed by embossing a surface of the sheet 36. Embossing may include pressing or compressing the sheet of material 36 at all locations along one of the exposed surfaces except where the friction members 14 are located. When using an embossing process, the thickness of all of the sheet of material 36 may be reduced except at the location of friction members 14. Other example methods of forming friction members 14 may include, for example, brazing, welding, machining (e.g., with a lathe, drill or mill), etching (e.g., acid etching), casting, press fitting, punching, dimpling and heat shaping. In one example, the friction members 14 are press fit from an inside surface toward an outside surface so that the friction members 14 are extending and/or protruding from an exposed exterior surface of the resultant tube-shaped friction bolt assembly. Further details regarding an example press and/or stamping method used to form the friction members is described below with reference to FIGS. 10A-10D.

FIG. 6C shows a further step in forming the friction bolt assembly, which includes wrapping or roll forming the sheet of material 36 into a tube 12. In the case of forming a friction bolt as opposed to other types of rock bolts, a slit 28 may be defined in the tube 12 with the slit having a width $W_S$ included between first and second edges 30, 32 (see FIGS. 7A and 7B).

FIG. 6D shows additional features added to friction bolt assembly 10 including, for example, tapered portion 34 located at distal end 20, and flange 16 added at proximal end 22. In other examples, the tapered portion 34 may be pre-formed in the sheet of material 36 such that the taper is provided upon rolling the sheet of material 36 into the tube 12 shape shown in FIG. 6C. In other embodiments, the friction members 14 may be formed on the tube 12 rather than being formed on the sheet of material 36 prior to being rolled into the shape of tube 12.

FIGS. 7A and 7B show steps of inserting a friction bolt assembly 10 into a bore 4 of an earthen formation 2. The bore 4 is formed in a ceiling surface 6 of the earthen formation 2. The friction bolt assembly 10, when inserted into bore 4, may hold a mesh material 38 against the ceiling surface 6.

FIG. 7A shows the tapered portion 34 of tube 12 partially inserted into bore 4. FIG. 7A shows the bore having a diameter $D_B$ that is smaller than the maximum diameter $D_T$ of the tube 12. The friction members 14 extend radially outward from the outer surface 24 of tube 12, which is beyond the diameter $D_T$. The slit 28 has a width $W_S$ defined between first and second edges 30, 32 that is reduced in size as the friction bolt assembly 10 is inserted into bore 4.

FIG. 7B shows friction bolt assembly 10 fully inserted within bore 4. FIG. 7B shows the slit 28 with a reduced width $W_S$ and reduced diameter $D_T$ as compared to the width and diameter shown in FIG. 7A. The reduced width $W_S$ and diameter $D_T$ results from the radially inward compressive forces applied to tube 12 as friction bolt assembly 10 is inserted into bore 4. The diameter $D_T$ may be substantially the same as the bore diameter $D_T$ after the tube 12 is inserted into the bore 4.

Bore 4 has a substantially fixed inner diameter $D_B$. In at least some examples, the friction members 14 may scrape, rub, abrade, scar, scrape or the like the internal surface of bore 4 as friction bolt assembly 10 is inserted into bore 4. When an axial force is applied in a direction opposite of the insertion direction, the proximal end edge 42 and/or proximal end surface 48 of friction members 14 engages with the inner-surface of bore 4 as shown in FIG. 7D. This engagement with and frictional interface between the friction members 14 and inner surface of bore 4 provides increased pull strength for friction bolt assembly 10 as compared to a friction bolt assembly without friction members 14. The increased pull strength may provide additional support for mesh material 38.

Figure 9A:
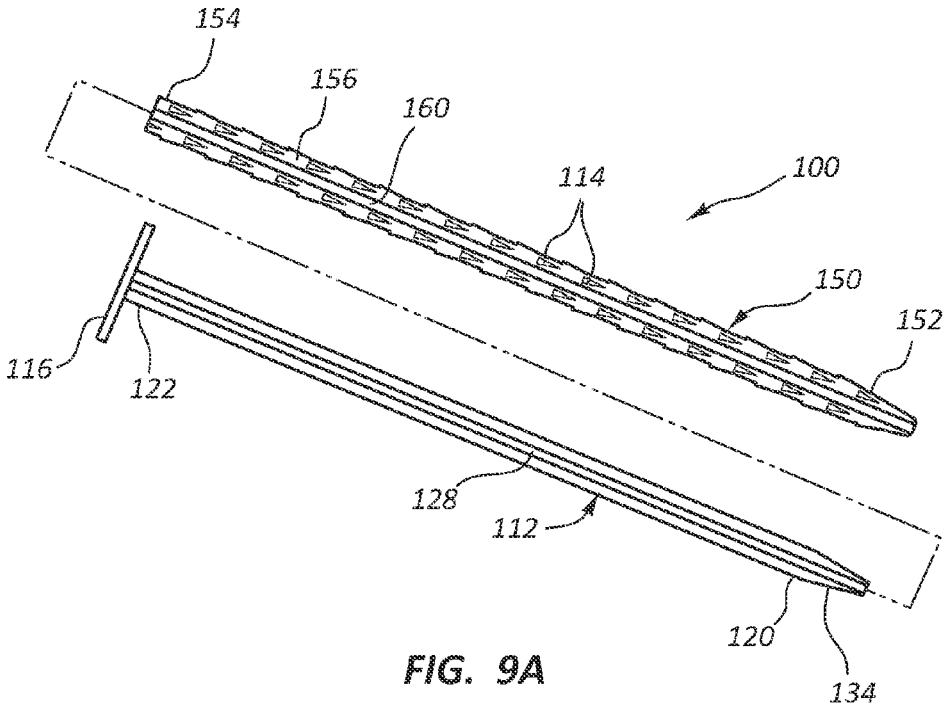
FIG. 9A is an exploded perspective view of another example friction bolt assembly in accordance with the present disclosure.
Figure 9B:
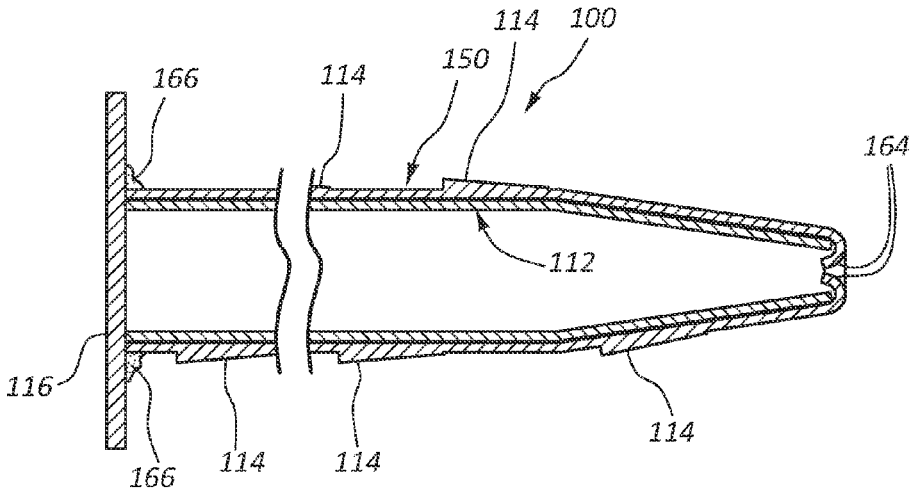
FIG. 9B is a cross-sectional view of a portion of the friction bolt assembly shown in FIG. 9A.

Referring to FIGS. 9A and 9B, another example friction bolt assembly 100 is shown and described. Friction bolt assembly 100 includes a tube 112, a plurality of friction members 114, a flange 116, and a sleeve 150. The friction members 114 are positioned on the sleeve 150. The flange 116 may be mounted directly to tube 112, or may be connected to sleeve 150, or may be connected to a combination of the sleeve 150 and the tube 112.

Typically, the friction bolt assembly 110 is assembled by first forming and/or otherwise providing the tube 112 and the sleeve 150 with the friction members 114 positioned on an exposed exterior surface thereof. The tube 112 is then inserted into sleeve 150. Sleeve 150 may be connected to tube 112 using at least one of a connection at the distal end 120 of tube 112 and a connection at the proximal end 122 of tube 112.

Sleeve 150 may include distal and proximal ends 152, 154, an outer surface 156 (and a corresponding inner-surface that is not labeled), a slit 160, a tapered end 162, and a distal lip 164. Tube 112 includes a slit 128 and a tapered portion 134. The tapered portion 134 may mate with the tapered end 162 of sleeve 150. When assembled together, the slit 160 of sleeve 150 may be aligned with slit 128 of tube 112, although other arrangements are possible in which the slits 160, 128 are not aligned with each other.

When the friction bolt assembly 100 is assembled together as shown in the cross-sectional view of FIG. 9B, the distal end 120 of tube 112 may engage with distal lip 164 of sleeve 150. A proximal connection 166 may be applied at the proximal end 122 of tube 120 to secure tube 112 to sleeve 150 and/or to connect sleeve 150 to flange 116. The flange 116 may be pre-mounted to the proximal end 122 of tube 112.

The sleeve 150 may include the plurality of friction members 114, but may lack sufficient structural rigidity by itself to avoid collapsing while being inserted into a bore. As such, sleeve 150 may be mounted to (e.g., positioned on, wrapped around, or fit on) an exterior surface of the tube 112. The combination of tube 112 with sleeve 150 may provide the necessary structural rigidity for friction bolt assembly 100 while also providing improved pull strength by inclusion of the friction members 114.

Sleeve 150 may be mounted or otherwise connected to tube 112 in various other ways including, for example, using fasteners (e.g., bolts, rivets, or the like), an adhesive or other bonding agent, welds, interference fit connections, and the like. In some embodiments, sleeve 150 may have a length that is less than the length of tube 112. In some embodiments, a plurality of individual sleeves 150 may be positioned on a single tube 112, such as sleeves that are positioned in series along a length of tube 112. Sleeves of different sizes (e.g., thicknesses, diameters, slit size, and the like) may be used to help customize a friction bolt assembly 100 for a particular bore size (e.g., diameter $D_B$).

The sleeve 150 may be modified to operate in conjunction with an expansion bolt, a cement/resin bolt, or other type of rock bolt. Sleeve 150 may be expandable, deformable, adjustable, and the like in order to operate with a particular type of rock bolt. Generally, sleeve 150 is provided with one or more friction members so that the friction members do not have to be formed in a main body portion of a rock bolt assembly (e.g., tube 12 shown in FIGS. 1-5). Providing the friction members on a separate piece such as sleeve 150 may provide additional options for forming the friction members and/or creating friction members of particular shapes, sizes, orientations or other features or characteristics to be used for a particular rock bolt.

Figure 10A:
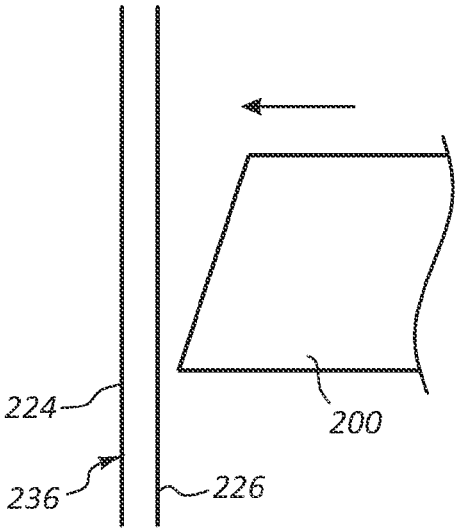
FIGS. 10A-10D show steps of forming a friction member for use in a friction bolt assembly in accordance with the present disclosure.
Figure 10B:
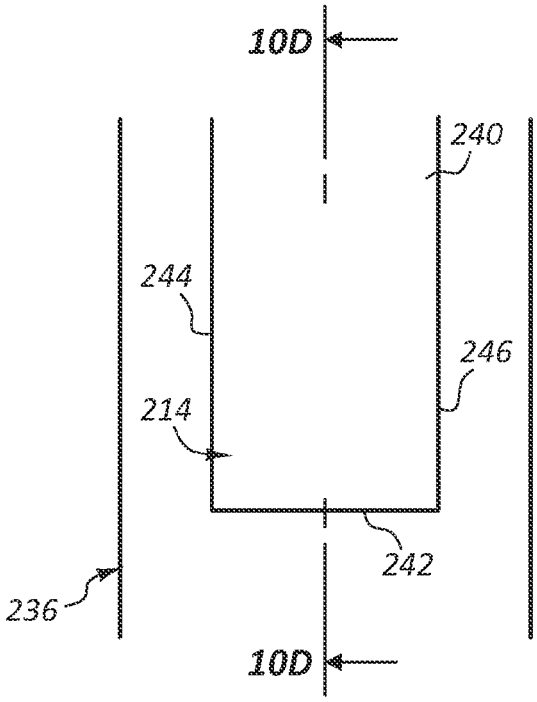
Figure 10C:
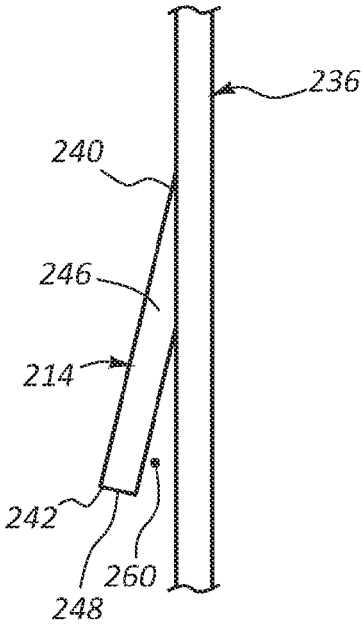
Figure 10D:
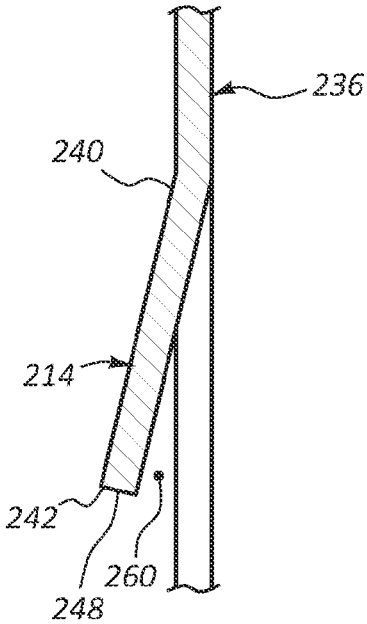

FIGS. 10A-10D illustrate features and related method steps for forming a friction member 214 in a sheet of material 236. The friction member 214 may be formed from the inside surface 226 to an outer surface 228 of the sheet of material 236. A punch 200 may engage the inner surface 226 of sheet 236 in a generally perpendicular direction as shown in FIG. 10A. Punch 200 may force a portion of the sheet 236 away from the remaining portion of sheet 236 to form friction member 214, as shown in FIGS. 10B-10D.

FIG. 10B shows the friction member 214 having a generally rectangular shape. Friction member 214 may be attached at a distal end to 40 as shown in FIGS. 10B-10C, and be detached from the remaining portions of the sheet at a proximal and edge 242. Friction member 214 may also include lateral edges 244, 246 shown in FIG. 10B and a proximal end surface 248 shown in FIGS. 10C and 10D. FIG. 10C shows a side view of the friction member 214. FIG. 10D shows a cross-sectional view of the friction member 214 shown in FIG. 10B taken along cross-section indicators 10D-10D.

The punch 200 may have various shapes, sizes and orientations in order to provide the desired shape, size and orientation for friction member 214. In some embodiments, the friction member 214 is defined by a deformed portion of sheet 236. The deformed portion may remain in contact around its entire perimeter with the remaining portions of sheet 236 as opposed to having a portion thereof detached to create a gap 260, as shown in the embodiment of FIGS. 10C and 10D. The friction member 214 may have a tapered structure along its length between its distal and proximal ends, and may have a tapered structure between opposing lateral sides 244, 246.

The various friction members disclosed herein typically protrude from the outer surface of the friction bolt assembly. Other embodiments may include friction members that extend from both the outer and inner surfaces depending on, for example, a manufacturing method used to form the friction members. In some embodiments, the friction members may be formed by passing a sheet of material or a tubular shaped structure through a forming machine that simultaneously forms a plurality of friction members in a single step. In other embodiments, each individual friction member is formed individually in separate steps. In one example, a relatively large, continuous sheet of material may have a pattern of friction members formed thereon, and the sheet of material is then passed through a cutting, stamping or other machine that divides the sheet of material into individual strips that are sized and shaped to be roll formed into a tubular shaped structure for use as the rock bolt. A rolled tubular shaped structure may have its opposing edges (e.g., lateral sides 44, 46 of tube 12 shown in FIG. 2) connected together to form a continuous circumferential structure rather than maintaining a slit as in the embodiment of FIGS. 1-5.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions.

The terms "including:" and "having" come as used in the specification and claims shall have the same meaning as the term "comprising."

What is claimed is:

1. A friction bolt, comprising:

an elongated metal tube, comprising:

interior and exterior surfaces;

a tapered distal end portion;

a proximal end portion;

a slit extending along a length of the elongated metal tube;

a plurality of friction members extending outward from the exterior surface, at least some of the friction members having an exposed planar portion to frictionally engage an inner surface of a bore within which the friction bolt is inserted, the plurality of friction members being connected to the exterior surface around a perimeter of each of the plurality of friction members to maintain a fixed position relative to the exterior surface, wherein at least some of the friction members have a tapered thickness from a distal end toward a proximal end of the friction members.

2. The friction bolt of claim 1, wherein at least some of the friction members have a triangular shape.

3. The friction bolt of claim 2, wherein the triangular shape has a greater length than width, and the friction members are oriented with the length aligned with a length dimension of the elongated metal tube.

4. The friction bolt of claim 2, wherein the triangular shaped friction members are oriented pointing toward the distal end portion.

5. The friction bolt of claim 1, wherein the friction members are formed integrally as a single piece with the elongated metal tube.

6. The friction bolt of claim 1, further comprising a flange positioned at the proximal end portion, the flange being configured to support a mesh.

7. The friction bolt of claim 1, wherein the friction members are arranged in a pattern on the exterior surface.

8. The friction bolt of claim 1, wherein the exposed planar portion extends along a proximal end surface of the at least some of the friction members.

9. The friction bolt of claim 1, wherein the exposed planar portion extends along lateral side surfaces of the at least some of the friction members.

10. The friction bolt of claim 1, wherein the interior surface being smooth and free of discontinuities.

11. A friction bolt, comprising:

an elongated tube, comprising:

a slit extending along at least a portion of a length of the elongated tube;

a plurality of friction members extending outward from an exterior surface of the elongated tube, at least some of the friction members having at least one linear edge, the plurality of friction members being connected to the exterior surface around a perimeter of each of the plurality of friction members to maintain a fixed position relative to the exterior surface, wherein at least some of the friction members have a tapered thickness from a distal end toward a proximal end of the friction members.

12. The friction bolt of claim 11, wherein at least some of the friction members include a plurality of planar surfaces.

13. The friction bolt of claim 11, wherein at least some of the friction members include a plurality of linear edges.

14. The friction bolt of claim 11, wherein at least some of the friction members include a pointed distal tip.

15. The friction bolt of claim 14, wherein the pointed distal tip is oriented pointing toward a tapered distal end portion of the elongate tube.

16. The friction bolt of claim 11, wherein at least some of the friction members have a tapered width along their lengths.

17. The friction bolt of claim 11, wherein at least some of the friction members include a planar surface having the at least one linear edge.

18. The friction bolt of claim 11, wherein the friction members are arranged in a pattern of rows and columns.

19. The friction bolt of claim 11, wherein the elongate tube further comprises an interior surface, the interior surface being smooth and free of discontinuities.

* * * * *